US007326840B2

(12) United States Patent
Wanne

(10) Patent No.: US 7,326,840 B2
(45) Date of Patent: Feb. 5, 2008

(54) MOUTHPIECE FOR A MUSICAL INSTRUMENT

(75) Inventor: Allen Theodore Wanne, Bellingham, WA (US)

(73) Assignee: Wanne, Inc., Bellingham, WA (US)

( * ) Notice: Subject to any disclaimer, the term of this patent is extended or adjusted under 35 U.S.C. 154(b) by 140 days.

(21) Appl. No.: 11/216,826

(22) Filed: Aug. 31, 2005

(65) Prior Publication Data

US 2007/0044636 A1 Mar. 1, 2007

(51) Int. Cl.
*G10D 9/02* (2006.01)

(52) U.S. Cl. ..... 84/383 R

(58) Field of Classification Search ..... 84/383 R, 84/383 A, 385 A, 386, 380 A, 398, 387 A, 84/399

See application file for complete search history.

(56) References Cited

U.S. PATENT DOCUMENTS 6,673,992 B1 * 1/2004 Runyon ..... 84/383 R
6,686,525 B1 * 2/2004 Wu ..... 84/383 R

* cited by examiner

*Primary Examiner*—Kimberly Lockett
(74) *Attorney, Agent, or Firm*—Gottlieb, Rackman & Reisman, P.C.

(57) ABSTRACT

A mouthpiece for a woodwind instrument, such as a saxophone has a tubular body, with a front and a rear portion, each having a respective passage. The front portion has an opening that is at least partially covered by a reed. The front passage is wider then the opening. The front passage also has a bottom wall that descends toward the rear portion. The bottom wall has three zones, including a first zone disposed at a shallow angle with respect to the reed, a second zone with sharper angle then the first, and an end zone. The resulting mouthpiece generates smoother and fuller sounds then the prior art mouthpieces while at the same time projecting sounds more effective.

13 Claims, 4 Drawing Sheets

MOUTHPIECE FOR A MUSICAL INSTRUMENT

RELATED APPLICATIONS

None

BACKGROUND OF THE INVENTION

A. Field of Invention

This invention pertains to a mouthpiece for a musical instrument in the Woodwind family, such as a saxophone and the like, and more particularly, to a mouthpiece having a unique lumen for generating sounds more efficiently.

B. Description of the Prior Art

Woodwind instruments are referred to herein as musical instruments consisting of a main body used to define a column of air. As is well known in the art, within the body the acoustic characteristics of the column may be modified by various means that are beyond the scope of this invention. Importantly, the air column is vibrated by a reed disposed in a mouthpiece attached to the body intake by means of a metal, or other material, band. The reed is held on by this band which circumferences the entire outer body of the mouthpiece and which is tightened by a built in tightening mechanism. The present invention pertains to improvements to the mouthpiece.

Mouthpieces for musical instruments have been made for centuries. One musical instrument mouthpiece is shown in U.S. Pat. No. 5,293,805. However, the existing mouthpieces still have problems. More specifically, with existing mouthpiece devices there is a trade off between good sound projection and a warm, full bodied sound. In other words, a player had to choose a mouthpiece that had a good sound but did not project well. While a mouthpiece with these characteristics may be useful for solo performances, it was not useful for performances in which the player was part of an ensemble, group or band because his part was lost within the sound produced by the other instruments. Alternatively, if the player chose a mouthpiece that carried well and projected the sounds so that the player could participate effectively as part of an ensemble, the sound quality of the instrument was poor, so that the player preferred not to use it for solo performances. Of course, most performances are mixed, with the player having some solo parts, and some ensemble parts, often within the same song, and therefore changing mouthpieces is not very practical.

SUMMARY OF THE INVENTION

In view of the above there is a need for a mouthpiece that resolves the problems associated with the prior art. This is accomplished by providing a mouthpiece that has several improvements over the prior art.

A mouthpiece constructed in accordance with this invention has an elongated body forming a front and a rear portion. The rear portion is generally cylindrical and is shaped for mounting on a saxophone. The front portion includes a top surface receiving a reed and forming an elongated opening under the reed, starting at the lip. The front portion also forms a passageway extending under the opening. This passageway has sidewalls and a bottom. The sidewalls are tapered and are spaced further from each other then the width of the opening. As a result, the passageway is wider then the opening, from directly behind the initial opening all the way into the center of the mouthpiece, providing a fuller sound. The bottom of the passageway starts off from the tip at a shallow angle, during a first stage. The second stage is slightly more tapered then the first. Both sections are somewhat raised in relation to the angle formed between the start of the first stage and the end of the third stage. At the stat of the third stage, the passageway plunges downward into a somewhat spherical large chamber, the end of which connects with the smaller cylindrical interior of the rear portion. This shape has been found to provide full-bodied sounds as compared to the sharp sounds formed with other saxophone mouthpieces. In addition, the sounds are projected much more effectively then by other mouthpieces.

DETAILED DESCRIPTION OF THE INVENTION

The mouthpiece constructed in accordance with this invention has a unique combination of shapes and features selected so that when it is installed on a saxophone, the saxophone produces sounds that are full, well rounded and pleasant. Moreover, as opposed to saxophones with previous mouthpieces, the present full and pleasant sounding mouthpiece also projects sounds well. Previous inventions accomplished one of these qualities, but not both simultaneously.

Figure 5A:
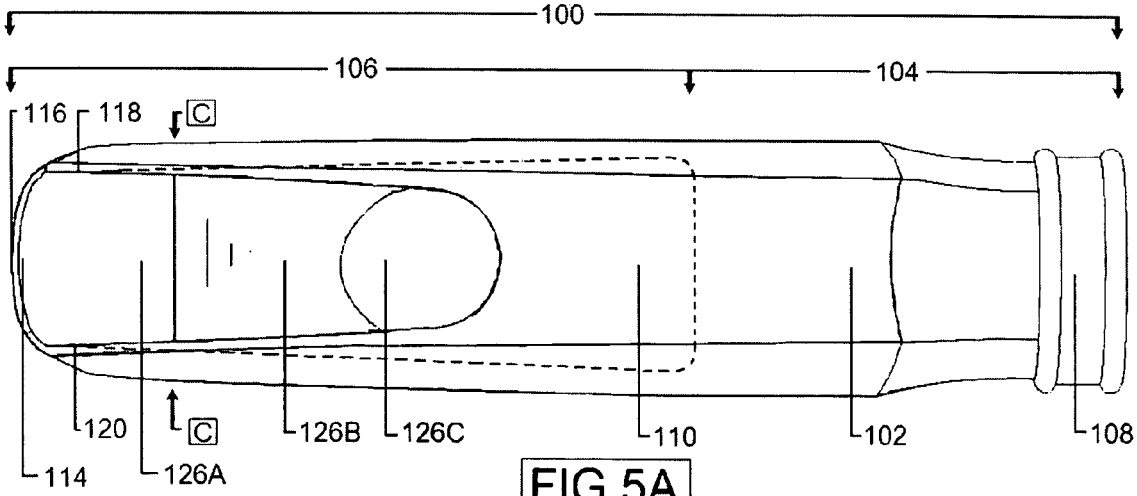
FIGS. 5A, 5B, 5C how respectively a plan view, a side sectional and a cross-sectional view of a novel mouthpiece constructed in accordance with this invention, FIG. 5C being taken along cutting plane C-C in FIG. 5B.
Figure 5B:
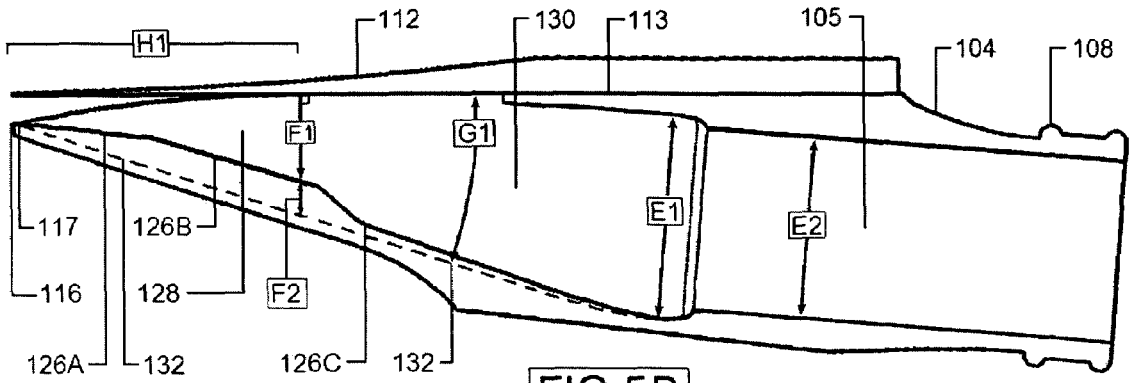
Figure 5C:
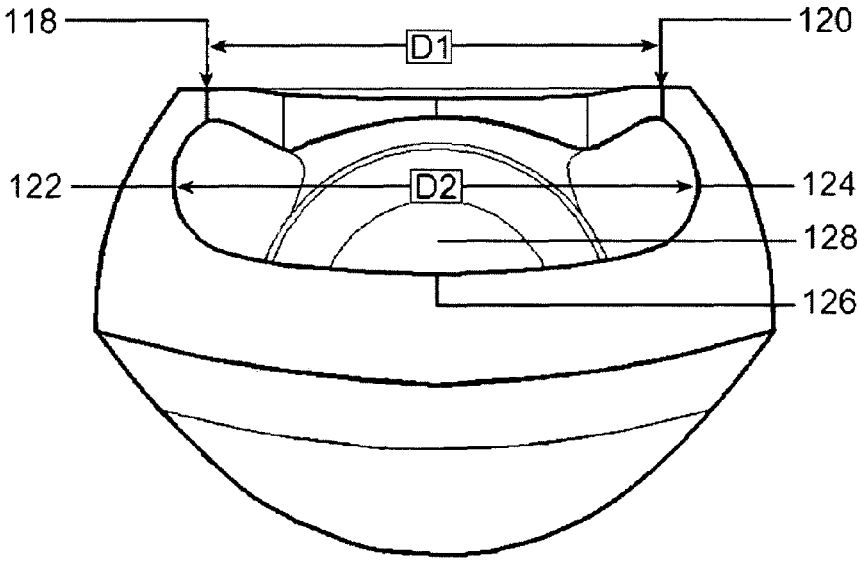

Referring now to FIGS. 5A, 5B and 5C, a mouthpiece 100 constructed in accordance with this invention has a generally elongated body 102 formed with two axially spaced portions 104, 106. The rear portion 104 has a generally cylindrical interior 105, known as a bore, and is formed with outer ridges 108 for mounting the mouthpiece on the saxophone (not shown). The front portion 106 has a flat top surface 110 that supports a reed 112 in the usual manner. For the sake of clarity, the reed 112 has been omitted from FIGS. 5A and 5C. The top surface is formed with an elongated opening 114 extending to the lip 116. The opening 114 has two lateral sidewalls 118, 120. The front portion 106 also has two vertical walls 122, 124 and a bottom wall 126.

As best seen in FIG. 5C, the two sidewalls 122, 124 are angled slightly outwardly, and the sidewalls 118, 120 extend slightly inward to form slight overhangs, resulting in a rounded passageway 128 through front portion 106 that is wider in the middle then at the top, e.g., near the reed 112. In other words, the distance D1 between the sidewalls 118, 120 is smaller then the distance D2 between sidewalls 122, 124. Moreover, sidewalls 122, 124 are tapered sideways so that passageway is wider near the bottom 126 then near the opening 114.

Another feature of the mouthpiece is the shape of the bottom wall 126. As can be seen in FIG. 5B, the bottom wall 126 has three stages or steps 126A, 126B, 126C. Starting at the lip 117, the beginning stage 126A is a relatively short stage, having a length in the range of ⅛" to 1 ¼", forming a high baffle in the passageway 128. As can be seen in FIG. 5B, 126A must be at an angle G1 less than 18 degrees, but greater than 0, relative to the bottom surface 113 of reed 112. Reed 112 is assumed to be perfectly flat, parallel, and flush with the flat portion of mouthpiece 100 it is clamped to. The next or intermediate stage 126B constitutes a shallow drop which must be at an angle greater than the angle G1 of 126A. The last stage, 126C, drops down at a much steeper rate and is somewhat spherical to form a large chamber, 130, connecting to the smaller cylindrical bore 105 of rear portion 104. Imaginary line 132 in FIG. 5B and the real bottom wall in FIG. 1B, is the straight line between the tip 117 and the widest part of the chamber, E1. The angle between 132 and the bottom surface 113 of the reed 112, has been shown to equal 18 degrees in the prior art mouthpiece shown in FIG. 1B. In order to create the three step floor of 126 in this invention, the angle of 126A must be smaller than 18 degrees, and greater than 0 degrees which would be parallel with surface 113. Hence the bottom floor 126 is consistently raised above line 132. For instance, in the middle, or intermediate zone, bottom wall 126B is separated by a distance F2 from line 132.

Preferably, bottom wall 126A is at an angle of 7 degrees, and bottom wall 126B is at angle of about 17 degrees. Preferably, bottom wall 126A has a length of ½". At distance H1 (measuring along the flat of 113 from the tip of the reed) of 1", the drop of bottom wall 126B indicated as F1 is 5/16" and distance F2 is ⅛". As discussed above, bottom wall 126A must be smaller than 18 degrees and can be between ¼ to ¾ of an inch long. Bottom wall 126B can have an angle equal to or smaller than 18 degrees, but greater than the angle of 126A. Hence, distance F2 is always be greater than 0. The transition of bottom wall 126B into bottom wall 126C occurs when H1 is less than 1½ inches, and F1 at this point is less than F1 when H1 is at point E1.

Lastly, the diameter of chamber 130, E1, is greater than the bore, E2 upon which the mouthpiece is mounted to the musical instrument.

Figure 1A:
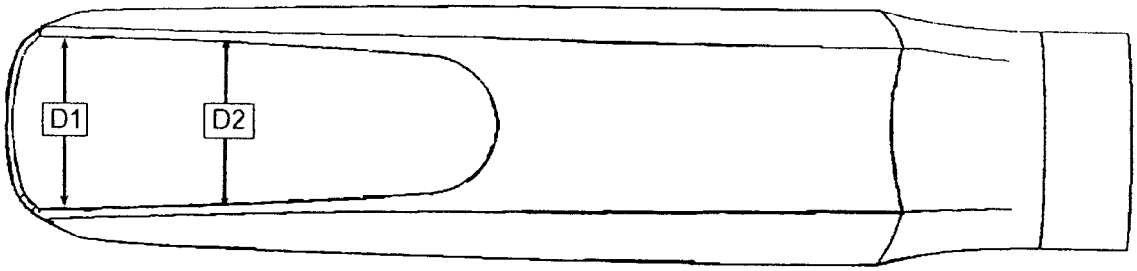
FIG 1A PRIOR ART
FIGS. 1A, 1B, 2A, 2B, 3A, 3B and 4A, 4B show respective top and side views of various prior art mouthpieces.
Figure 1B:
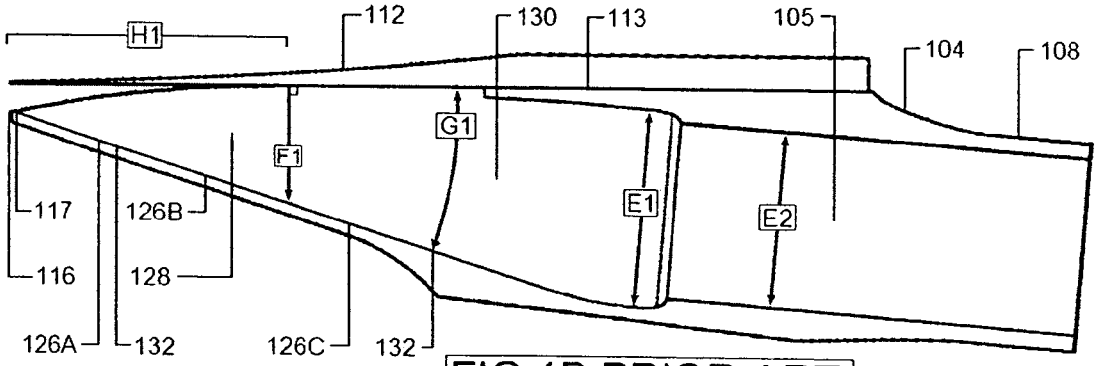
FIG 1B PRIOR ART
Figure 2A:
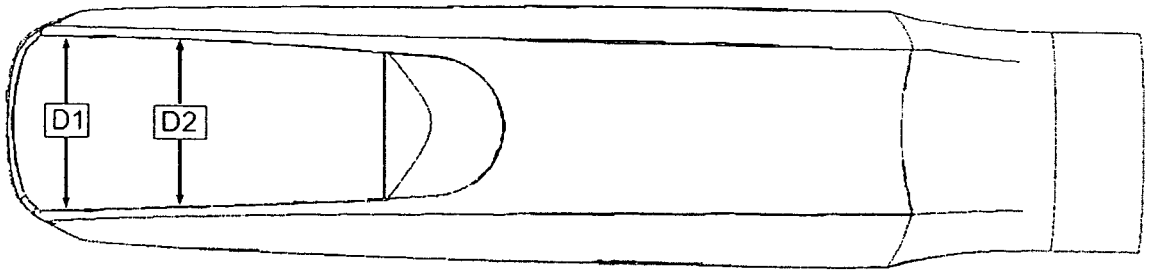
FIG 2A PRIOR ART
Figure 2B:
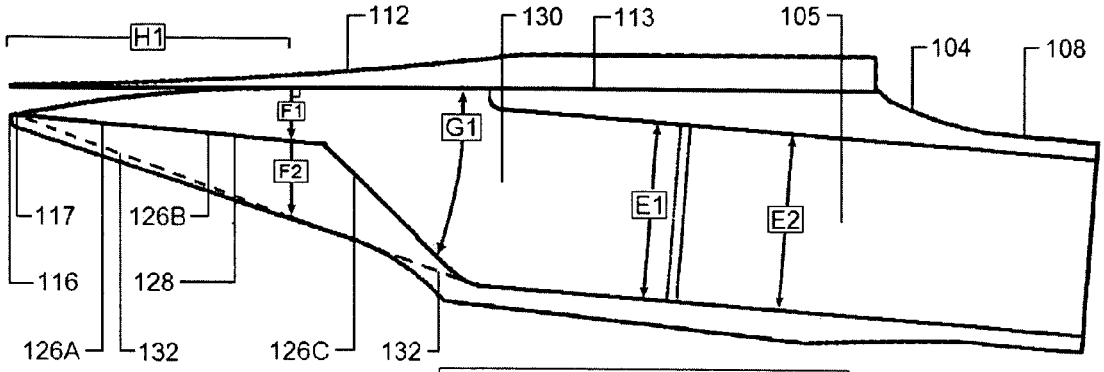
FIG 2B PRIOR ART
Figure 3A:
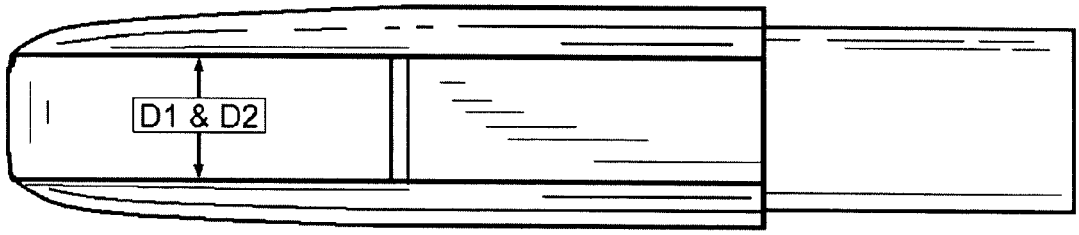
FIG 3A PRIOR ART
Figure 3B:
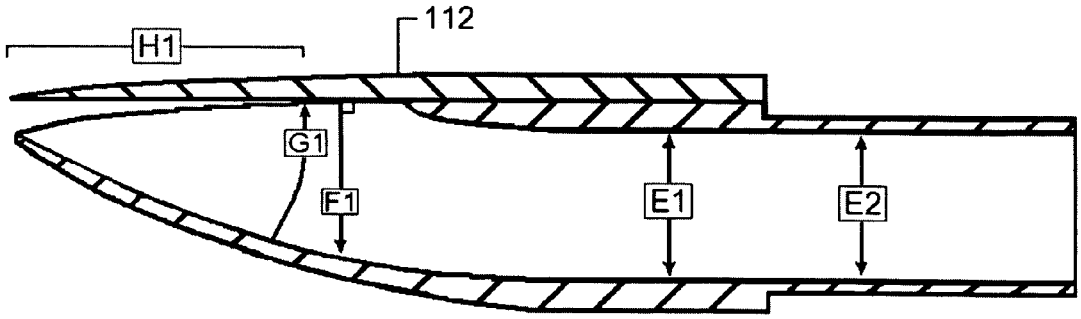
FIG 3B PRIOR ART
Figure 4A:
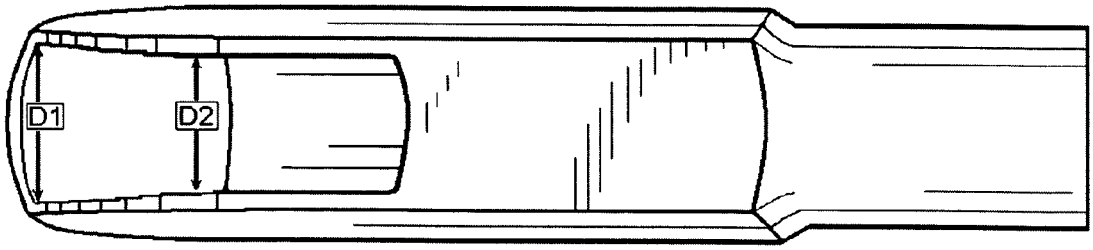
FIG 4A PRIOR ART
Figure 4B:
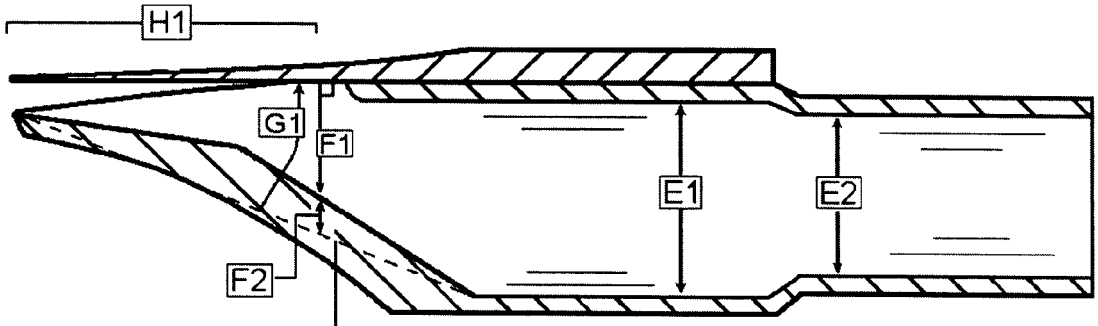
FIG 4B PRIOR ART

FIGS. 1A & 1B show a prior art mouthpiece in which D2 exists larger than D1 and E1 is larger than E2, however the bottom wall 126 is flat from its inception at 117 into the chamber at 126C, hence bottom wall 126 coincides with line 132. The angles of 126A and 126B are at an identical angle of 18 degrees relative to the bottom of the reed, 113. This creates a fat and warm sound, but since the angle of bottom wall 126 is not smaller than 18 degrees, no projection of the sound can be heard from the mouthpiece. A similar result is heard from prior art mouthpiece of FIGS. 3A & 3B as the bottom wall 126 is actually at a greater angle G1 than line 132, and hence is greater than 18 degrees.

In contrast FIGS. 2A, 2B, 4A & 4B show prior art mouthpieces with bottom wall 126A at an angle less than 18 degrees, however bottom wall 126B is omitted. Distance D2 is also not shown to be larger than D1, creating a bright and projecting sound, but not one that is warm, full and fat.

The unique shape of the invention provides the mouthpiece 100 with the following advantages. The shapes and sizes of the sidewalls 118, 120, 122, 124 form passageway 128 with a rounded cross-section that is wider inside the mouthpiece then at the top. As a result, the passageway 128 is larger than the passageway in prior art mouthpieces. The result of this feature is that the air flow through the passageway 128 widens creating a fuller, warmer and wider sound. At the same time, the shallow stages 126A, 126B insure that the airflow keeps moving and the sound is projected outwardly of the mouthpiece 100. While maintaining the sound projection the fuller and fatter sound produced by the shape of the sidewalls is assisted by the sudden drop created by stage 126C leading into section 130, E1 being larger than E2. In other words, the wider passageway and large chamber provide better quality of sound and the high bottom wall 126, dropping off in stages within the mouthpiece provides better sound projection.

While the invention is described primarily as being used for saxophones, similar mouthpieces may be used for other instruments such as clarinet within the woodwind family of musical instruments.

Obviously, numerous modifications can be made to the invention without departing from its scope as defined in the appended claims.

I claim:

1. A saxophone mouthpiece comprising an elongated body having a front and a rear portion; said rear portion being shaped for mounting on a saxophone and the front portion having a front passageway formed between a bottom wall and two sidewalls and an opening above the bottom wall, said passageway having a width wider than said opening, and said bottom wall being formed with a first zone starting from the front and descending gradually and a second zone descending more rapidly then said first zone and a ledge between said first and said second zone.

2. The mouthpiece of claim 1 wherein said sidewalls are tapered sideways so that said front passageway is wider near the bottom wall then near the opening.

3. The mouthpiece of claim 1 wherein said bottom wall comprises three stages, including a first, an intermediate and a last stage, said stages descending gradually from a lip to said opening.

4. The mouthpiece of claim 3 wherein said first stage starts from said lip at an angle in the range of 0-17 degrees with respect to a top surface of said body.

5. The mouthpiece of claim 4 wherein said intermediate zone descends at angle greater than said first stage.

6. The mouthpiece of claim 5 wherein said last stage has a partially spherical shape.

7. The mouthpiece of claim 1 wherein said rear portion has a tubular rear passageway, said rear passageway having a diameter smaller than said front passageway.

8. A woodwind mouthpiece comprising a generally cylindrical body with a rear portion having a rear passage and being shaped and sized to be secured to a musical instrument, and a front portion having a flat opening accepting a reed and a front passage in communication with said rear passage and being shaped and constructed to produce a full sound that is projected loudly through said opening, said front passage having a width wider than said opening, and said bottom wall being formed with a first zone starting from the front and descending gradually and a second zone descending more rapidly then said first zone and a ledge between said first and said second zone

9. The woodwind mouthpiece of claim 8 wherein said front portion includes sidewalls and a bottom wall defining said front passage, said sidewalls being spaced at a greater distance then the width of said opening to project sounds effectively.

10. The woodwind mouthpiece of claim 8 wherein said front passage is formed with bottom wall partitioned into said first zone, an intermediate zone and said second zone, said zones forming different angles with said opening.

11. The woodwind mouthpiece of claim 10 wherein said first zone forms a high baffle.

12. The woodwind mouthpiece of claim 8 wherein said front passage has a front diameter and said rear passage has a rear diameter with said front diameter being larger than said rear diameter.

13. The woodwind mouthpiece of claim 8 wherein said rear portion is adapted to be mounted on a saxophone.

* * * * *